US010849380B2

(12) United States Patent
Brinkmann

(10) Patent No.: US 10,849,380 B2
(45) Date of Patent: Dec. 1, 2020

(54) PIECE OF SPORTS AND LEISURE CLOTHING HAVING A GEOMETRIC PATTERN THEREON

(71) Applicant: PictureUnited GmbH, Kreuzlingen (CH)

(72) Inventor: Ralph Brinkmann, Kreuzlingen (CH)

(73) Assignee: PictureUnited GmbH, Kreuzlingen (CH)

( * ) Notice: Subject to any disclaimer, the term of this patent is extended or adjusted under 35 U.S.C. 154(b) by 547 days.

(21) Appl. No.: 15/187,538

(22) Filed: Jun. 20, 2016

(65) Prior Publication Data

US 2017/0360128 A1 Dec. 21, 2017

(51) Int. Cl.
*A41H 3/00* (2006.01)
*A41D 27/08* (2006.01)
(Continued)

(52) U.S. Cl.
CPC ..... *A41D 27/08* (2013.01); *A41D 13/0015* (2013.01); *A41H 3/007* (2013.01); *D06Q 1/00* (2013.01)

(58) Field of Classification Search
CPC ..... A41H 3/007; A41H 3/04; A41H 3/08
(Continued)

(56) References Cited

U.S. PATENT DOCUMENTS 5,775,240 A * 7/1998 Hara ..... D05B 19/12 112/102.5
6,968,255 B1 * 11/2005 Dimaridis ..... D05B 19/08 112/475.19
(Continued)

FOREIGN PATENT DOCUMENTS

CN 101427852 A 5/2009
JP 2006075368 A 3/2006

OTHER PUBLICATIONS

Extended European Search Report issued in the corresponding European Application No. 16183828.9-1731, dated Sep. 21, 2017 (9 pages).
(Continued)

*Primary Examiner* — Nathan E Durham
(74) *Attorney, Agent, or Firm* — Ohlandt, Greeley, Ruggiero & Perle, LLP

(57) ABSTRACT

The present invention relates: to a piece of sports and leisure clothing, having a geometric pattern thereon, wherein the geometric pattern comprises at least one base item having a base boundary that forms the contour of the base item, a surrounding area that encompasses the base item, wherein the surrounding area is divided into a plurality of subareas, and a plurality of images, wherein within each subarea of the plurality of subareas at least one image of the plurality of images is disposed, such that the base boundary is visually defined by the plurality of images. The present invention further relates to a piece of sports and leisure clothing, having a geometric pattern thereon, wherein the geometric pattern comprises a base item having a base boundary, an area, wherein the area is encompassed by the base boundary, and wherein the area is divided into a plurality of subareas, a plurality of images, wherein within each subarea of the plurality of subareas one image of the plurality of images is disposed, such that the base boundary is visually defined by the plurality of images.

2 Claims, 10 Drawing Sheets

(51) Int. Cl.
*D06Q 1/00* (2006.01)
*A41D 13/00* (2006.01)

(58) Field of Classification Search
USPC ..... 700/130–132
See application file for complete search history.

(56) References Cited

U.S. PATENT DOCUMENTS 8,731,703 B1* 5/2014 Lehrer ..... G06F 3/1257 700/132
9,008,818 B2* 4/2015 Mizuno ..... D05B 19/12 700/138
2001/0026272 A1* 10/2001 Feld ..... A41H 3/007 345/419
2005/0289018 A1* 12/2005 Sullivan ..... G06Q 30/00 705/26.5
2006/0031392 A1* 2/2006 Lunetta ..... G06T 11/60 709/217
2009/0030656 A1 1/2009 Doe, II et al.
2009/0222127 A1* 9/2009 Lind ..... A41H 3/007 700/132
2013/0115395 A1 5/2013 Johnson
2015/0066189 A1* 3/2015 Mulligan ..... G06F 3/04815 700/136
2015/0208746 A1* 7/2015 Schindler ..... A41H 3/007 700/132
2016/0015101 A1 1/2016 Stefanovic

OTHER PUBLICATIONS

European Office Action for corresponding application EP 16 183 828.9, 8 pages, dated Feb. 28, 2020.

* cited by examiner

PIECE OF SPORTS AND LEISURE CLOTHING HAVING A GEOMETRIC PATTERN THEREON

TECHNICAL FIELD

The present invention relates to a piece of sports and leisure clothing, having a geometric pattern thereon, wherein the geometric pattern comprises at least one base item having a base boundary that forms the contour of the base item, a surrounding area that encompasses the base item, wherein the surrounding area is divided into a plurality of subareas, and a plurality of images, wherein within each subarea of the plurality of subareas one image of the plurality of images is disposed, such that the base boundary is visually defined by the plurality of images.

BACKGROUND ART

In the sports and leisure clothing industry it has become common to individualize pieces of clothing and other fan articles. Soccer jerseys, for example, are often created just for a single match. E.g. the names and flags of the competing teams are printed on the jersey. Such a jersey makes it possible that a fan can always remember a particular encounter of two teams. Furthermore, individualized jerseys often gain high values among collectors.

Another common phenomenon is the fact that many fans like to be as close as possible to their idols. For example, parents are willing to pay high prizes just to let their kids join the athletes when they run onto the soccer field. Jerseys or shoes worn by an athlete at a certain sports event gain high bids at auctions. Training camps often advertise with successful athletes to gain subscribers and subscriptions.

Hence, it is an object of the present invention to provide a piece of sports and leisure clothing which has individual characteristics on the one hand and satisfies the need of the fans to bring them closer to the athletes on the other hand.

SUMMARY OF THE INVENTION

In accordance with the present invention a piece of sports and leisure clothing, having a geometric pattern thereon, is provided, wherein the geometric pattern comprises at least one base item having a base boundary that forms the contour of the base item, a surrounding area that encompasses the base item, wherein the surrounding area is divided into a plurality of subareas, and a plurality of images, wherein within each subarea of the plurality of subareas at least one image of the plurality of images is disposed, such that the base boundary is visually defined by the plurality of images.

Hereinafter a "piece of sports and leisure clothing" can be one of a t-shirt, a jersey, a sweater, a sweatshirt, a jacket, a pair of trousers, a pair of shorts, a pair of socks, a pair of shoes, a scarf, a cap, a beany, a towel or the like. It may also be a piece of cloth which is used as a starting number in races and other sporting events.

A "geometric pattern" means a geometric pattern that is either printed onto, woven into, embroidered, glued on, ironed onto, Velcro fastened to, pinned to or sown onto the piece of sports and leisure clothing.

The "base boundary" forms the contour of the base item. It defines the abrupt transition from the base item to a surrounding area.

The "surrounding area" is the area that borders the base item.

When the description refers to the color of an area or image, then this means the predominantly perceived color of the area and image. The area and image may contain other colors or shades of colors.

With the aforementioned geometric pattern on a piece of sports and leisure clothing it is possible to illustrate a base item by means of a plurality of pictures or images. The illustration of the base item is generated by means of the arrangement of the images in relation to the base boundary, wherein the relation of the images among each other plays a minor role. The plurality of images is disposed along the base boundary such that the area inside the base boundary is free of images. Thereby, the base item is defined visually as the area that is surrounded by the images.

The base boundary itself is visible due to the colors and/or brightness of the plurality of images that substantially or at least noticeably differ from the color and brightness of the area inside of the base boundary, thus creating a contrast. This contrast, i.e. the abrupt transition from the base item to the surrounding area can be perceived visibly as the base boundary. Moreover, different shadings may be used in order to create the aforementioned contrast. In the latter case there is no need to provide different colors. Hence, it may be sufficient to only use different shades of grey, for example.

The colors used for the geometric pattern may be strong colors and/or soft colors. With soft colors, for example, it is possible to create a geometric pattern on the piece of sports and leisure clothing that has the appearance of a watermark.

In another embodiment of the piece of sports and leisure clothing the base item of the geometric pattern may be at least one of a numeral, a letter, a symbol, a logo, or an emblem. Hence, it is possible to illustrate information on the piece of sports and leisure clothing by means of the geometric pattern thereon. E.g. a number of a player, a name of a player and/or a team, advertisement, a club logo, and the like may be illustrated on the piece of sports and leisure clothing. Moreover, the base item may be an unstructured pattern such as water splashes or the like.

In a further embodiment of the piece of sports and leisure clothing the allocation of the plurality of images to the plurality of subareas, respectively, may be arbitrary. Thus, the images may be arranged randomly with respect to each other. Looking at the geometric pattern from a distance, e.g. from a 3 feet distance, the single images may not be recognizable. What is recognizable is the overall appearance, i.e. the at least one base item. Hence, not the single picture itself, but the at least one base item may be recognizable from the distance.

In yet another embodiment of the piece of sports and leisure clothing, each image of the plurality of images may comprise at least one of a signature, a slogan, a cheer, and a portrait. Thereby, the signature of a fan and/or of an athlete may be used as image for the plurality of images. Furthermore, the image may be a slogan, e.g. of a fan, of a fan club, or of an athlete. Moreover, the image may be a cheer, e.g. of a fan, of a fan club, or of an athlete. Further, the image may be a portrait of a fan, a fan club, an athlete, team members, and the like.

With the aforementioned different options for the content of the single images of the plurality of images the piece of sports and leisure clothing may be provided with a geometric pattern being individualized on the one hand and conveying a general piece of information on the other hand. Individual information of fans and/or athletes may be present in the geometric pattern in the form of the plurality of images, while general information such as the number of an athlete and/or the name of a team may be visualized by means of the entire geometric pattern, in particular, by means of the at least one base item.

According to a further embodiment, the plurality of images may be monochrome. That means that the pixels of the images are of a single color and only differ in terms of brightness or shading. Thereby, a surrounding area may be provided that consist of a single color. In case the surrounding area substantially extends over the entire remaining piece of sports and leisure clothing, the piece of sports and leisure clothing may be provided in a single color although being covered by the plurality of images. E.g. a jersey may be provided in the color of a club while being covered with the plurality of images. In this context a single image, in particular the allocation of a single image with respect to the other images is irrelevant. The fact that the plurality of images is monochrome contributes to the overall appearance.

In another embodiment, the surrounding area is divided into sections, wherein the plurality of images of each section is monochrome, while the color of the plurality of images of a section differs from the color of the plurality of images of an adjacent section. Thereby, patterns such as stripes, check, squares, circles, and the like may be provided in the surrounding area. In case the surrounding area extends over the entire piece of sports and leisure clothing, the piece of sports and leisure clothing may be provided with a pattern or multiple patterns although being covered by the plurality of images. In case of a pattern in the form of stripes, each stripe forms a section. The plurality of images within each stripe is monochrome, whereas the color differs from stripe to stripe. E.g. a jersey may be provided in different colors of a club while being covered with the plurality of images. In this context a single image, in particular the allocation of a single image with respect to the other images within a section is irrelevant.

In a further embodiment, the size of the subareas may vary. Thus, the size of the images among each other may vary.

In yet a further embodiment, the shape of the image may either be square, triangular, oval or round or may have any other geometric shape. It is also envisaged that shape of the images may vary over the subareas.

According to yet another embodiment, at least one image of the plurality of images is cropped in order to fit into the respective subarea.

In a further embodiment, the surrounding area may be encompassed by an outer boundary, wherein the outer boundary substantially may have the same contour as the base boundary, wherein the outer boundary and the base boundary may be spaced apart from each other under a substantially constant distance, thereby creating a frame area surrounding the base item. By encompassing the surrounding area the outer boundary limits the extension of the surrounding area, so that the surrounding area corresponds to a frame area, within which the plurality of images is disposed. Hence, in addition to the visual definition of the base item, the plurality of images defines a frame area that visually defines an edge of the base item. Thus, the information of the base item, e.g. a numeral, a letter, a symbol, a logo, and an emblem and the like, can also be perceived from the frame area itself.

In another embodiment, an inner boundary may be disposed within the base item, wherein the inner boundary substantially may have the same contour as the base item, wherein the base boundary and the inner boundary may be spaced apart from each other under a constant distance, wherein the surface enclosed by the inner boundary may be divided into an inner plurality of subareas, wherein within each subarea of the inner plurality of subareas at least one image of the plurality of images may be disposed. Thus, by means of the inner boundary the information of the base item, e.g. a numeral, a letter, a symbol, a logo, and an emblem and the like, may be illustrated already by means of the inner boundary. In this case the part of the base item that is disposed between the base boundary and the inner boundary appears as a frame area that surrounds the plurality of pictures disposed within the inner plurality of subareas.

Furthermore, a piece of sports and leisure clothing, having a geometric pattern thereon, is provided, wherein the geometric pattern comprises a base item having a base boundary, an area, wherein the area is encompassed by the base boundary and wherein the area is divided into a plurality of subareas, a plurality of images, wherein within each subarea of the plurality of subareas at least one image of the plurality of images is disposed, such that the base boundary is visually defined by the plurality of images.

With the aforementioned geometric pattern on a piece of sports and leisure clothing it is possible to illustrate a base item by means of a plurality of pictures. The illustration of the base item is generated by means of the arrangement of the images in relation to the base boundary, wherein the relation of the images among each other plays a minor role. The plurality of images is disposed along the base boundary such that the area inside the base boundary is filled with images. Thereby, the base item is defined visually as the area that is filled with the images.

The base boundary itself is visible due to the colors and/or brightness of the plurality of images that substantially or at least noticeably differ from the color and brightness of the area surrounding the base item, thus creating a contrast. This contrast, i.e. the transition from the base item to the surrounding area can be perceived visibly as the base boundary.

Moreover, a computer implemented method for generating a geometric pattern on a piece of sports and leisure clothing and a computer are provided, wherein the method comprises the steps of: loading surface data of the piece of sports and leisure clothing into the computer, loading data concerning a base boundary into the computer, wherein the base boundary forms the contour of a base item that is to be visualized on the piece of sports and leisure clothing, dividing the surrounding area of the piece of sports and leisure clothing outside the base item into a plurality of subareas, loading a plurality of images into the computer, distributing the plurality of images over the plurality of subareas, so that each subarea contains at least one image, thereby visually defining the base boundary by means of the arrangement of the plurality of images, generating the geometric pattern on the piece of sports and leisure clothing.

It should be emphasized that a key advantage of the present invention is that the step of loading a plurality of images into the computer is the result of a contribution of many individuals who have each loaded their image into a database, most likely from different locations, and the database then serves as the source for the plurality of images to be included in the geometric pattern.

By loading the surface data of the piece of sports and leisure clothing into the computer, the computer, i.e. a program running on the computer is provided with information about the piece of sports and leisure clothing, such as material, size of the area on which the geometric pattern is to be generated on, potential curvature of the surface on which the geometric pattern is to be generated on, and the like.

The data concerning the base boundary can be provided in the form of a file. The file can be generated on the computer by means of a graphical program such as Microsoft Paint, downloaded onto the computer from the internet, or uploaded to the computer by means of external memory devices such as a memory stick, a CD-ROM, an external disk, or the like.

The plurality of images can be loaded onto the computer by the same means as the base boundary data.

The step of generating the geometric pattern concerns physical creation of the geometric pattern on the piece of sports and leisure clothing.

In a further embodiment, the step of generating the geometric pattern on the piece of sports and leisure clothing comprises one of a printing method, a weaving method, sewing, and an embroidery method. E.g. in case of a printing method, the plurality of images are being printed onto the piece of sports and leisure clothing wherein the images are being distributing over the plurality of subareas, so that each subarea contains one image, thereby visually defining the base boundary by means of the arrangement of the plurality of images.

In another embodiment, the computer is connected to a textile printing machine. By means of such a textile printing machine the plurality of images can be printed onto the piece of sports and leisure clothing. As textile printing machine the ink jet textile printing apparatus disclosed in EP 2 857 209 A1 might be used. The computer forwards the information, i.e. the printing commands, generated by means of the aforementioned computer implemented method to a control unit of the textile printing machine, so that the textile printing machine is able to print the desired geometric pattern onto the piece of sports and leisure clothing. Before the actual printing is carried out a piece of sports and leisure clothing has to be inserted into a printing area of the textile printing machine.

Furthermore, a computer implemented method for generating a geometric pattern on a piece of sports and leisure clothing and a computer are provided, wherein the method comprises the steps of: loading surface data of the piece of sports and leisure clothing into the computer, loading a base boundary into the computer, wherein the base boundary forms the contour of a base item that is to be visualized on the piece of sports and leisure clothing, dividing an area that is encompassed by the base boundary into a plurality of subareas, loading a plurality of images into the computer, distributing the plurality of images over the plurality of subareas, so that each subarea contains one image, thereby visually defining the base boundary by means of the arrangement of the plurality of images, generating the geometric pattern on the piece of sports and leisure clothing.

Alternatively, a method for generating a geometric pattern on a piece of sports and leisure clothing may begin with the step of randomly distributing the images over the piece of sports and leisure clothing. In a following step the base item is placed on top of the randomly distributed images, thereby, covering the images that are disposed directly underneath the base item. The base item may be white and/or filled with a color. A contrast is created at the base boundary of the base item so that the base item can be visually perceived.

According to the aforementioned embodiments in each of the subareas at least one image is located. However, it is also possible that subareas are provided which are empty and therefore do not contain an image. For example, it is possible that only every second, third, or forth, etc. subarea contains an image.

The geometric pattern, which has been described in the context of a piece of sports and leisure clothing may also be provided on other articles which are related to the general realm of sports and sports merchandising, such as perimeter advertising, team busses, team airplane, golf cart, airships, stadium displays, sports equipment or the like. In general, all articles that are team related, i.e. that are used in the context of a team of athletes are envisaged.

The features of the aforementioned alternative embodiments are not intended to be essential for the invention.

BRIEF DESCRIPTION OF DRAWINGS

The invention will be more fully understood in view of the following detailed description of the invention, in conjunction with the drawings, of which.

DESCRIPTION OF EMBODIMENTS

Figure 1:
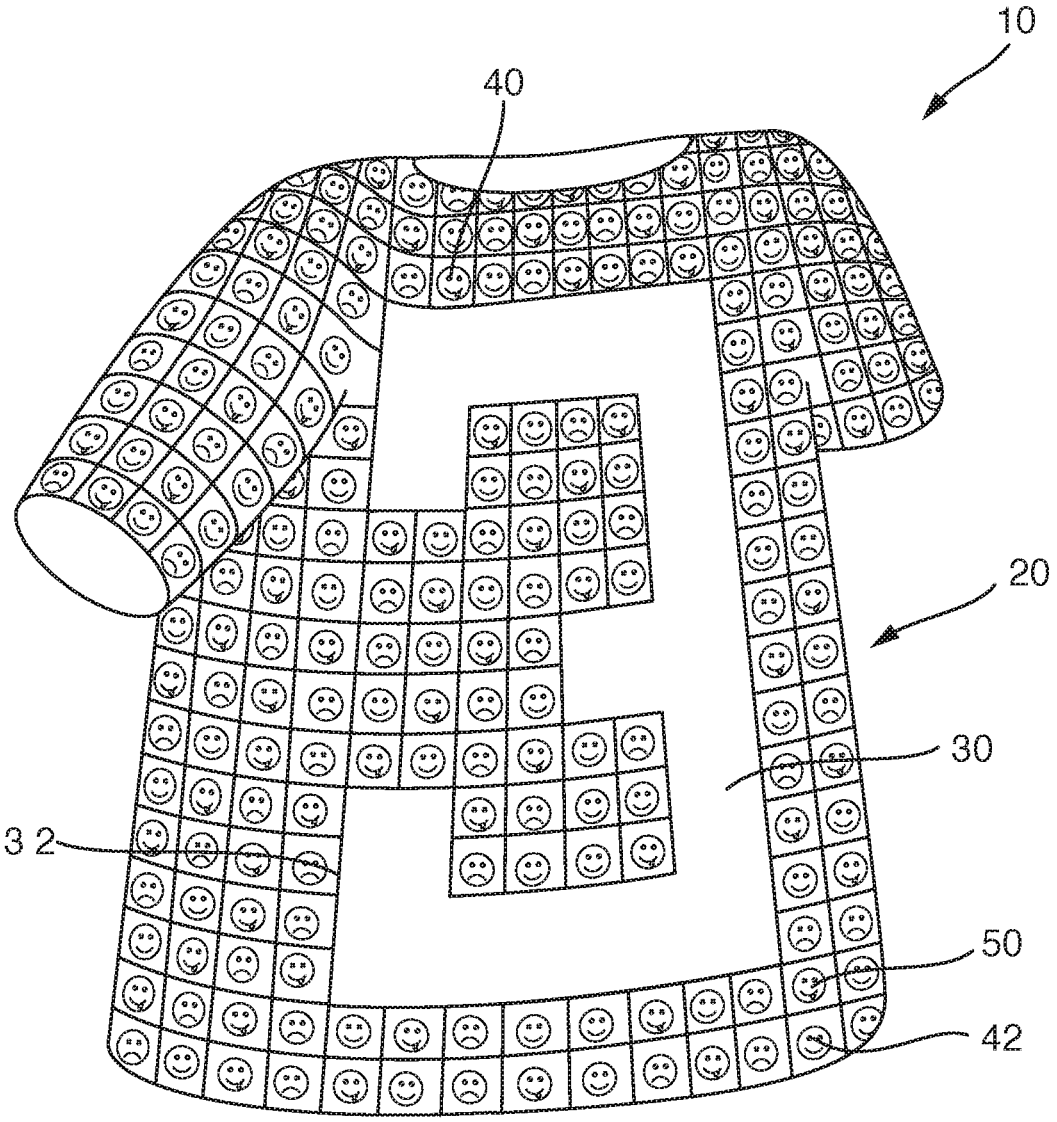
FIG. 1 is a diagram that schematically illustrates a perspective view of a piece of sports and leisure clothing, having a geometric pattern thereon.

Hereinafter, preferred embodiments are described by means of the Figures. Thereby, the same elements, similar elements, or elements with the same effect are indicated by identical reference signs. To avoid redundancies the following description partially goes without a repeated description of these elements FIG. 1 illustrates a piece of sports and leisure clothing 10, having a geometric pattern 20 thereon. In particular the piece of sports and leisure clothing 10 is a jersey. However, it may be any other piece of sports and leisure clothing, such as one of a t-shirt, a sweater, a sweatshirt, a jacket, a pair of trousers, a pair of shorts, a pair of socks, a pair of shoes, a scarf, a cap, a beany, and the like.

The geometric pattern 20 on the piece of sports and leisure clothing 10 comprises a base item 30 that embodies a number. Alternatively, the base item may embody at least one of a letter, a symbol, a logo, and an emblem.

The base item 30 is visually defined by means of a base boundary 32. The base boundary itself is defined by the surrounding area 40 adjacent to the base item 30. The surrounding area 40 is divided into a plurality of subareas 42. In each subarea 42 one image of the plurality of images 50 is located. The images 50 in the subareas 42 adjacent to the base item 30 create a contrast, thus visually defining the base boundary 32 and, thus, the base item 30. In other words, the base item 30 results from locating the images 50 in the subareas 42 of the surrounding area 40 by leaving out the area within the base boundary 30.

The geometric pattern shown in FIG. 1 extends over the entire jersey. I.e. the whole jersey is covered with images 50 except for the area of the base item. The images 50 show portraits of fans. Hence, the number on the jersey results from the arrangement of fan portraits on the jersey. Alternatively, the images may be at least one of a signature, a slogan, and a cheer.

For example, a fan may hand in his portrait at a team or club, he or she supports. Several portraits of different fans may be collected. The portraits are digitalized, e.g. by a scanning method. It is also possible that the fans hand in their portraits in a digitalized form, e.g. via a smart phone. The digitalized portraits are then via a database and server architecture forwarded to a textile printing machine, which is able to print the portraits onto a piece of sports and leisure clothing, such as a jersey. This is carried out by means of a computer implemented method that runs in a central processing unit of the textile printing machine. As input variables the computer implemented method needs the coordinates of the base item, in particular the coordinates of the base boundary. Moreover, the information of the size of the subareas has to be provided. Then, by means of the computer implemented method the images, i.e. the fan portraits, are randomly distributed over the sub areas. As a result the jersey comprises a geometric pattern of a plurality of portraits, wherein the portraits leave out an area which defines the base item, e.g. a number.

Figure 2:
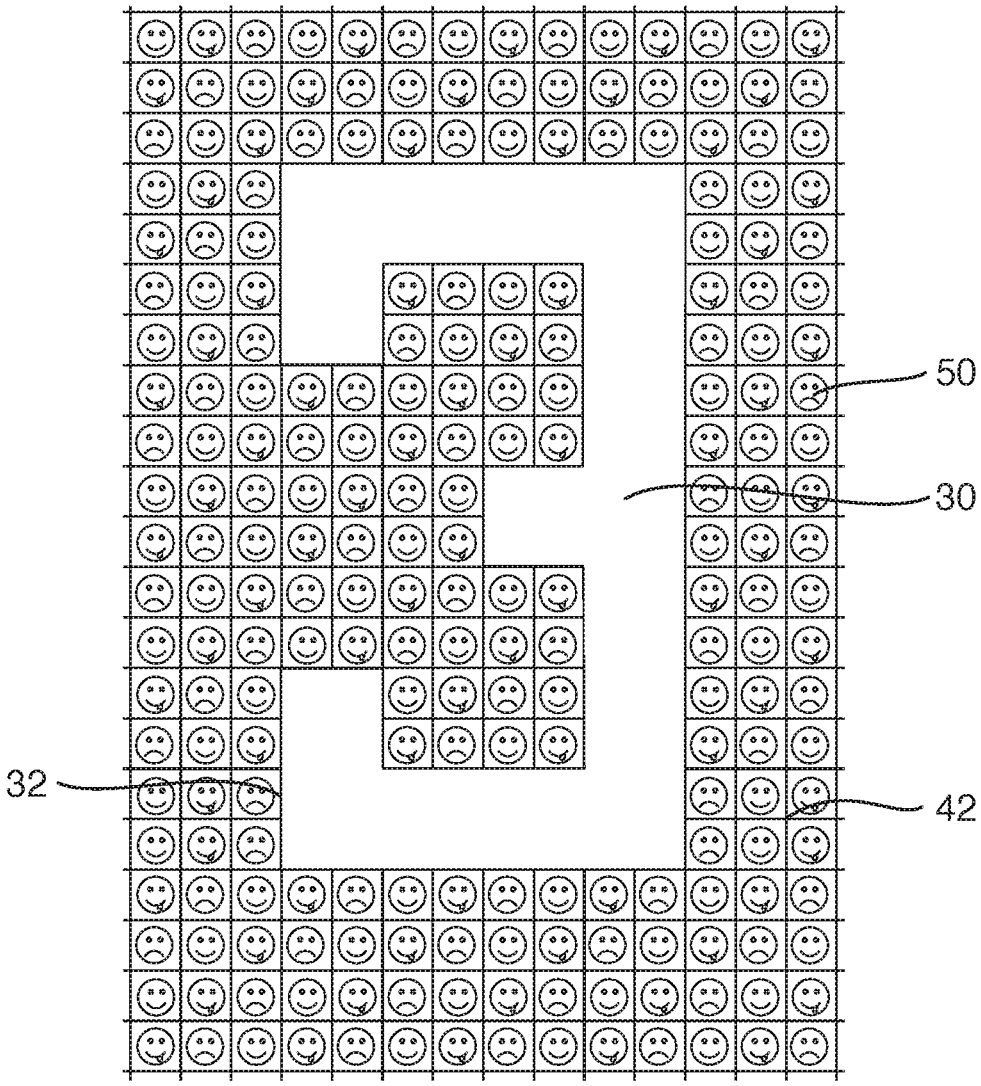
FIG. 2 is a diagram that schematically illustrates a detailed view of the geometric pattern of FIG. 1.

FIG. 2 illustrates a detailed view of the geometric pattern of FIG. 1. The images 50 are randomly distributed in the subareas 42. The space that is left out defines the base item 30. The contrast between the images 50 and the base item 30 defines a base boundary 32.

Figure 3:
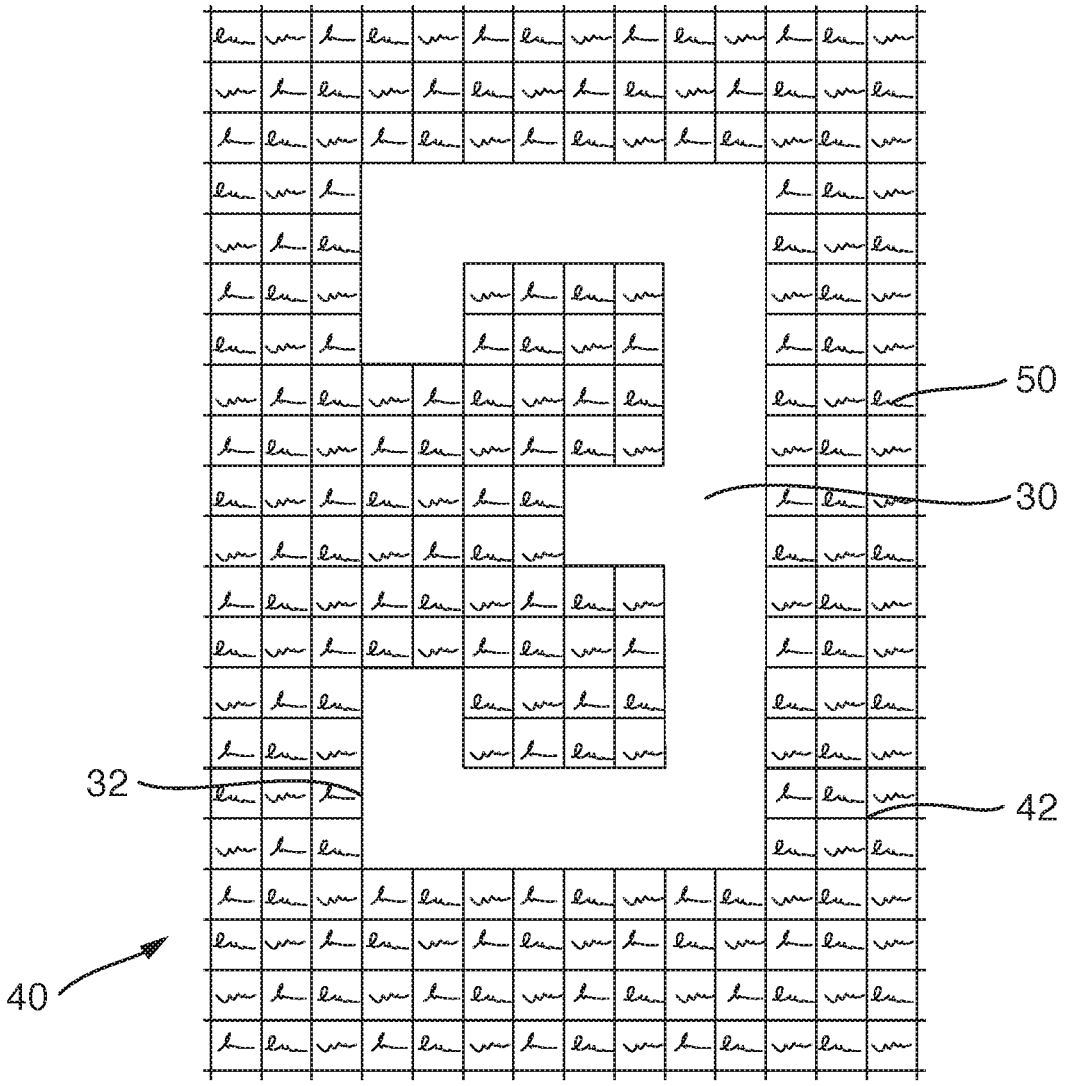
FIG. 3 is a diagram that schematically illustrates a detailed view of a geometric pattern.

FIG. 3 is a detailed view of a geometric pattern 20 on a piece of sports and leisure clothing, wherein the images distributed over the subareas 42 comprise signatures. These signatures may be signatures of fans, athletes, and the like.

Figure 4:
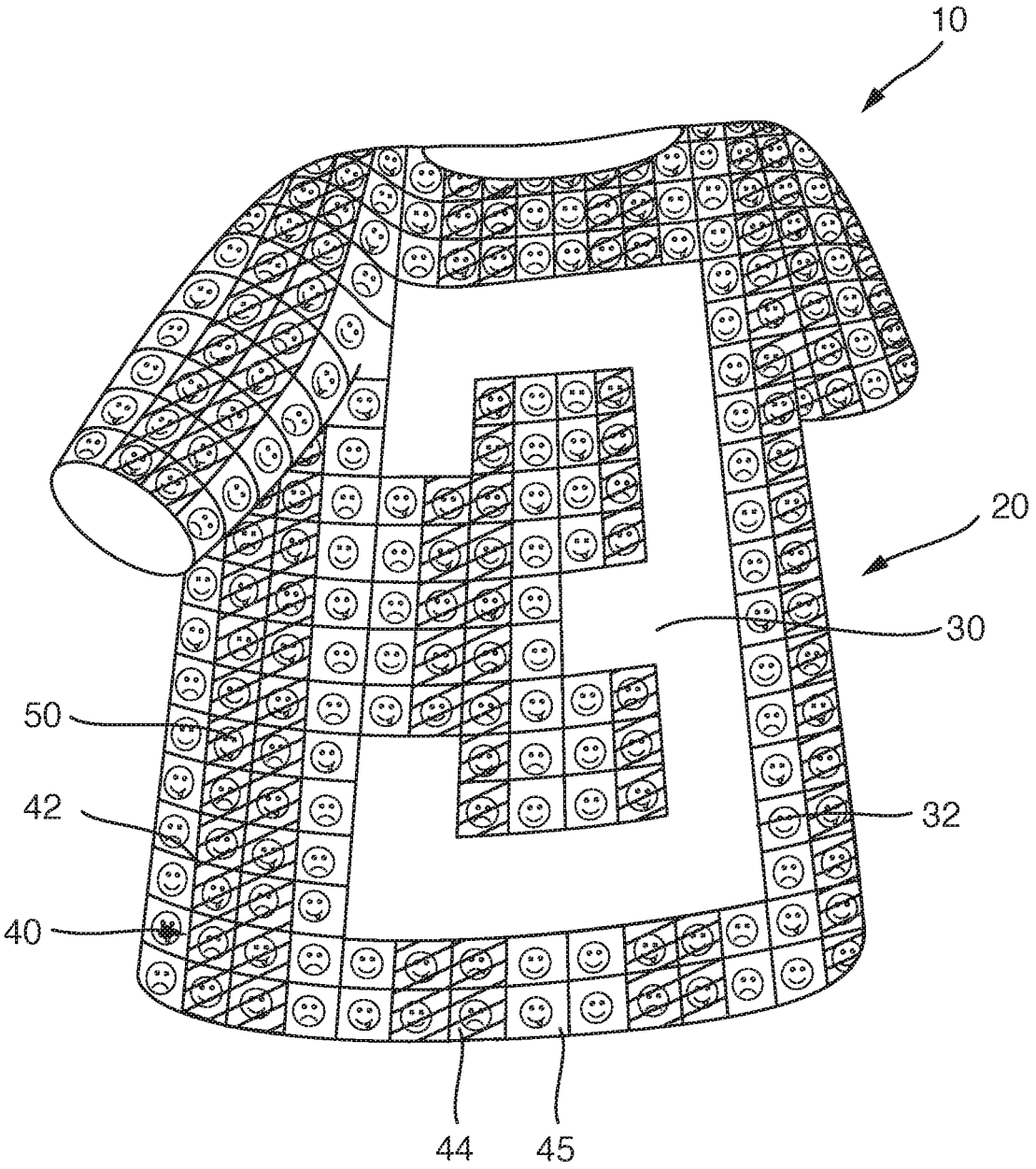
FIG. 4 is a diagram that schematically illustrates a perspective view of a piece of sports and leisure clothing, having a geometric pattern which comprises monochrome sections.

FIG. 4 illustrates a piece of sports and leisure clothing 10 in the form of a jersey having a geometric pattern 20 thereon. A base item 30 is visually defined as the base item of FIG. 1 with the difference that the surrounding area 40 is divided into sections 44, 45 of different colors. Each section 44, 45 has the form of a stripe. All images 50 located in the subareas 42 of one section 44 have the same color. I.e. the images 50 only comprise one color, wherein each image 50 is visualized by using one color only. In order to create contrasts within a single image 50, the brightness of the color may vary.

A section 45 adjacent to the section 44 also comprises images 50 of a single color. However, the color of section 45 differs from the color of section 44. Thus, the sections 44, 45 are visually defined by the use of different colors among two adjacent sections 44, 45. The sections 44, 45 of the piece of sports and leisure clothing shown in FIG. 4 in the form of stripes, results in a jersey with a striped pattern. Alternatively, other patterns such as check, squares, circles, and the like are possible.

Figure 5:
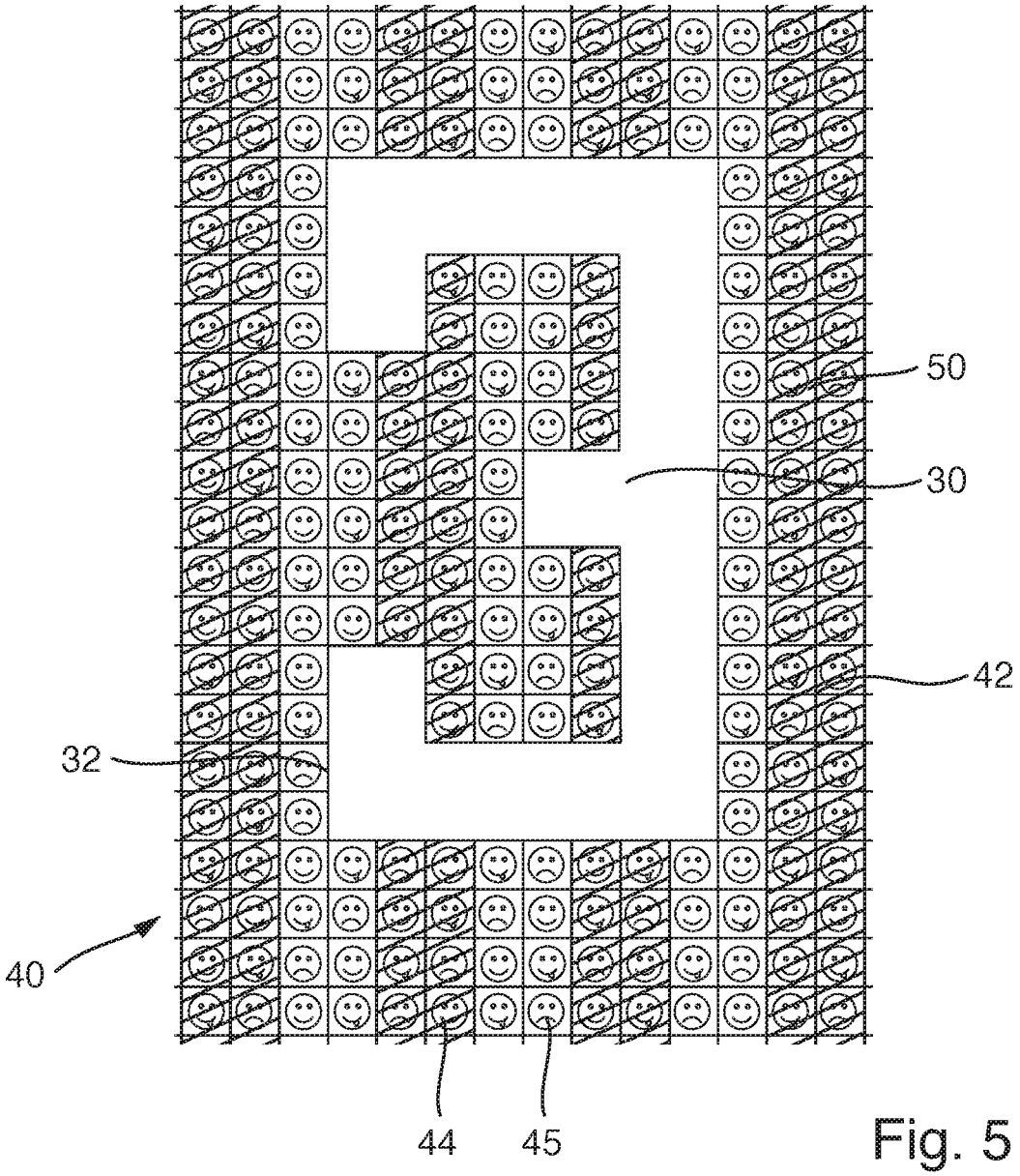
FIG. 5 is a diagram that schematically illustrates a detailed view of the geometric pattern of FIG. 4.

FIG. 4 shows two different colors alternating from section 44 to section 45. Alternatively, more than two different colors may alternate. FIG. 5 illustrates a detailed view of the geometric pattern of FIG. 4.

Figure 6:
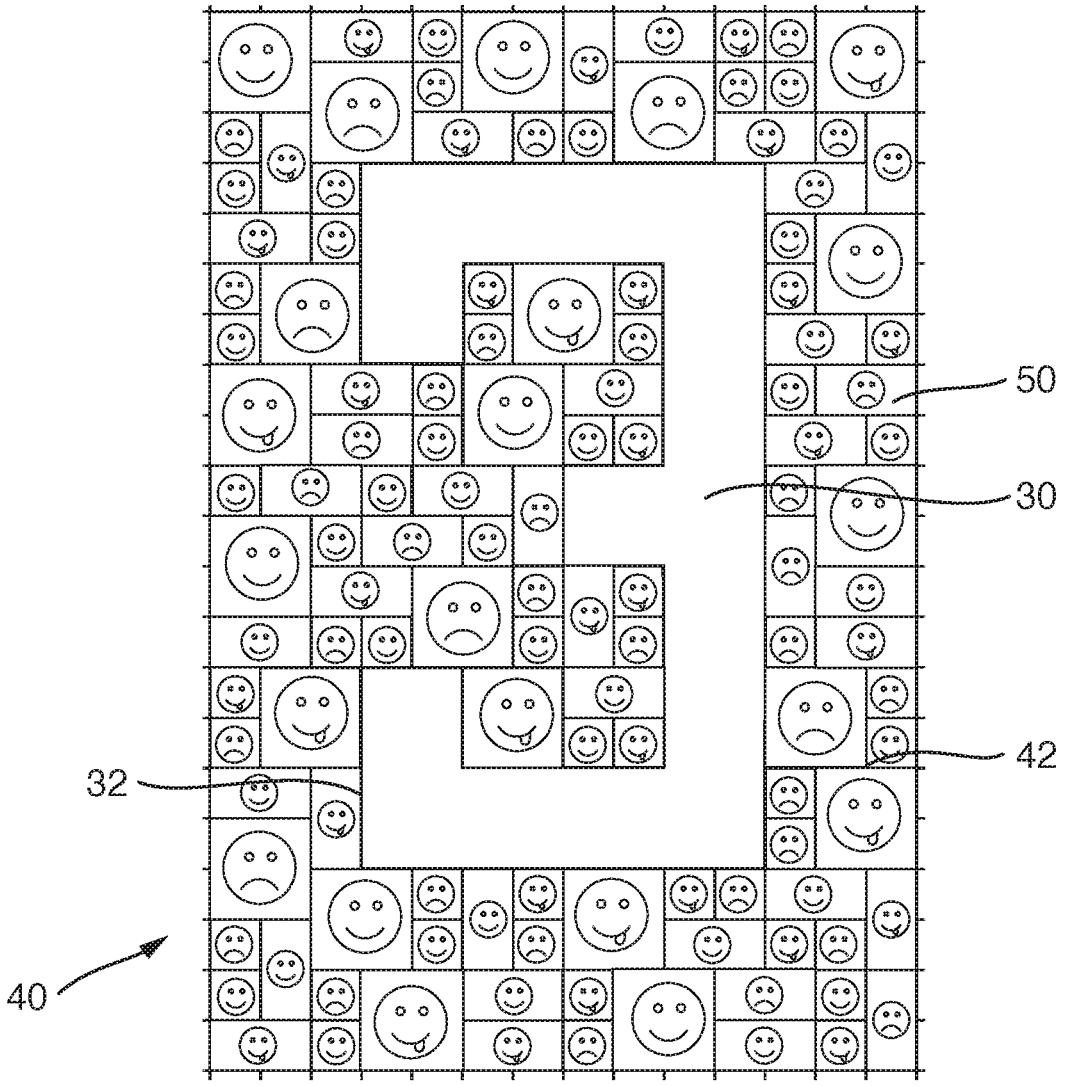
FIG. 6 is a diagram that schematically illustrates a detailed view of a geometric pattern.

FIG. 6 illustrates a detailed view of a geometric pattern 20 on a piece of sports and leisure clothing, wherein the subareas 42 are of different sizes. According to FIG. 6 also the images 50 are of different sizes.

Figure 7:
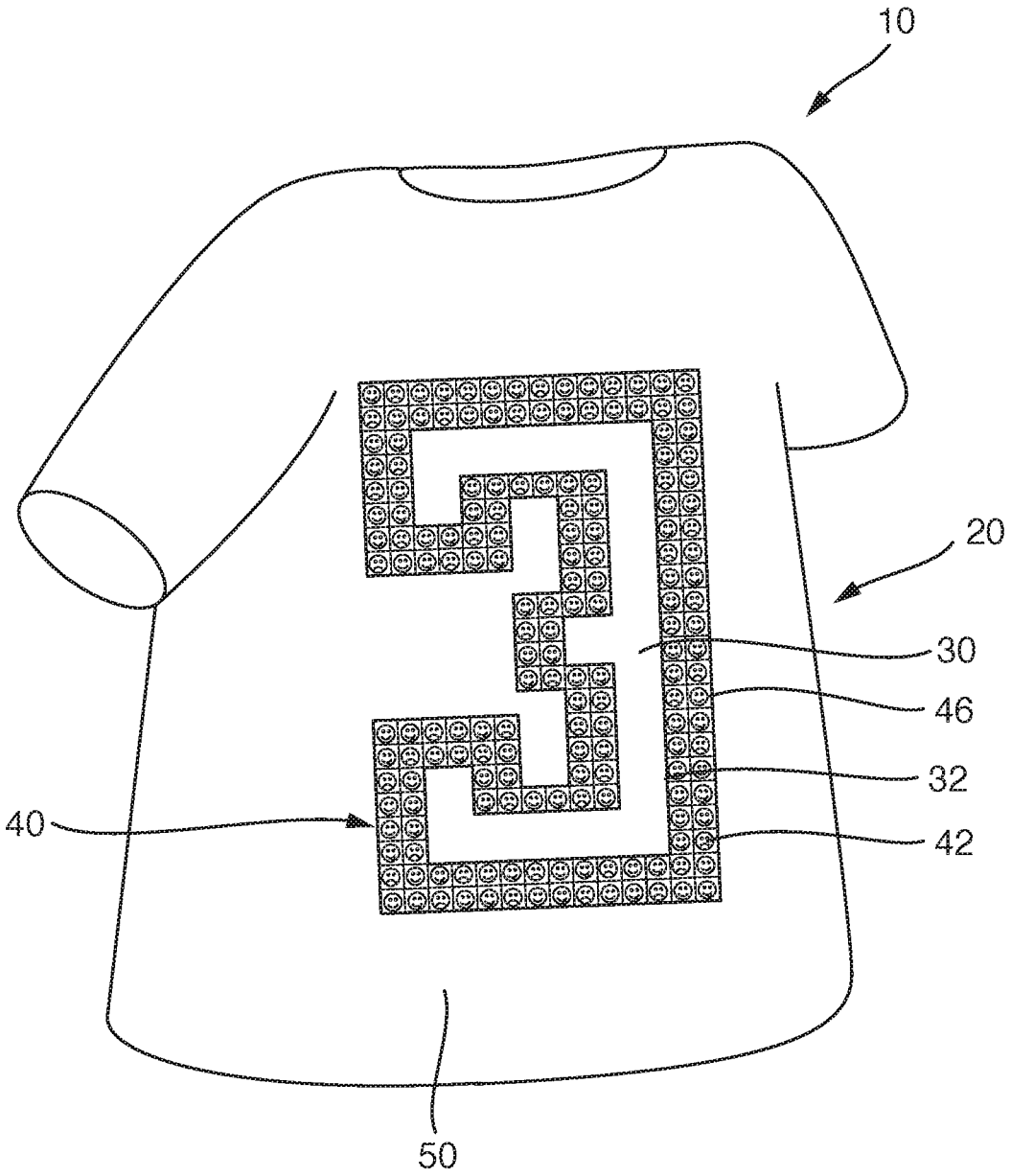
FIG. 7 is a diagram that schematically illustrates a perspective view of a piece of sports and leisure clothing, having a geometric pattern thereon.

FIG. 7 illustrates yet another embodiment of a piece of sports and leisure clothing 10 having a geometric pattern 20 thereon. A base item 30 is visually defined as the base item of FIG. 1 with the difference that the surrounding area 40 that is divided into subareas 42 is limited by an outer boundary 46. The outer boundary 46 encompasses the surrounding area 4 at a distance from the base boundary 32. Thus, the surrounding area 40 frames the base item 30. In particular, the surrounding area 40 runs around the base item 30 in the form of a frame area. The piece of information, that is inherent to the base item 30, i.e. a number in FIG. 7, is also being expressed by means of the surrounding area 40.

The distance between the base boundary 32 and the outer boundary 46 and thus the width of the frame area amounts to 1 inch. However, the distance may also be one of a range from 0.05 to 10 inches.

Figure 8:
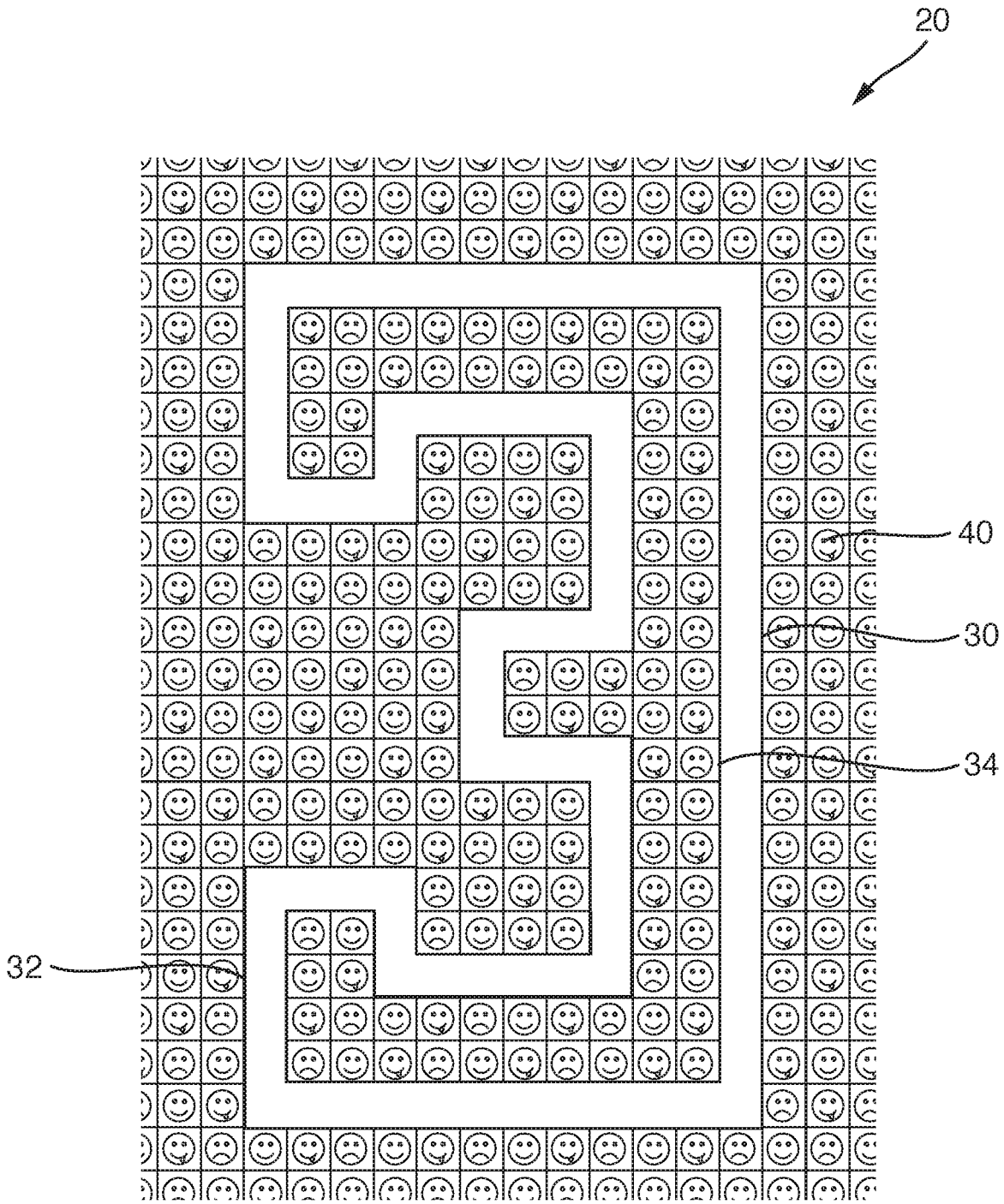
FIG. 8 is a diagram that schematically illustrates a detailed view of a geometric pattern.

FIG. 8 is a detailed view of a geometric pattern 20 on a piece of sports and leisure clothing similar to the geometric pattern of FIG. 1, with the difference that within the base item 30 an inner boundary 34 is provided that runs in a substantially constant distance with respect to the base boundary 32. Thus, the inner boundary 34 encloses an area within the base item 30. The area encompassed by the inner boundary 34 is divided into a plurality of subareas 36, wherein a plurality of images 50 is spread over the subareas 36. The distance between the base boundary 32 and the inner boundary 34 may be less than half of the width of the base item 30.

By means of the geometric pattern according to FIG. 8 the piece of information, that is inherent to the base item 30, i.e. a number in FIG. 8, is also being expressed by means of the plurality of images spread over the plurality of subareas 36 within the inner boundary 34, wherein the area of the base item 30 that lies between the base boundary 32 and the inner boundary 34 acts as a frame.

Figure 9:
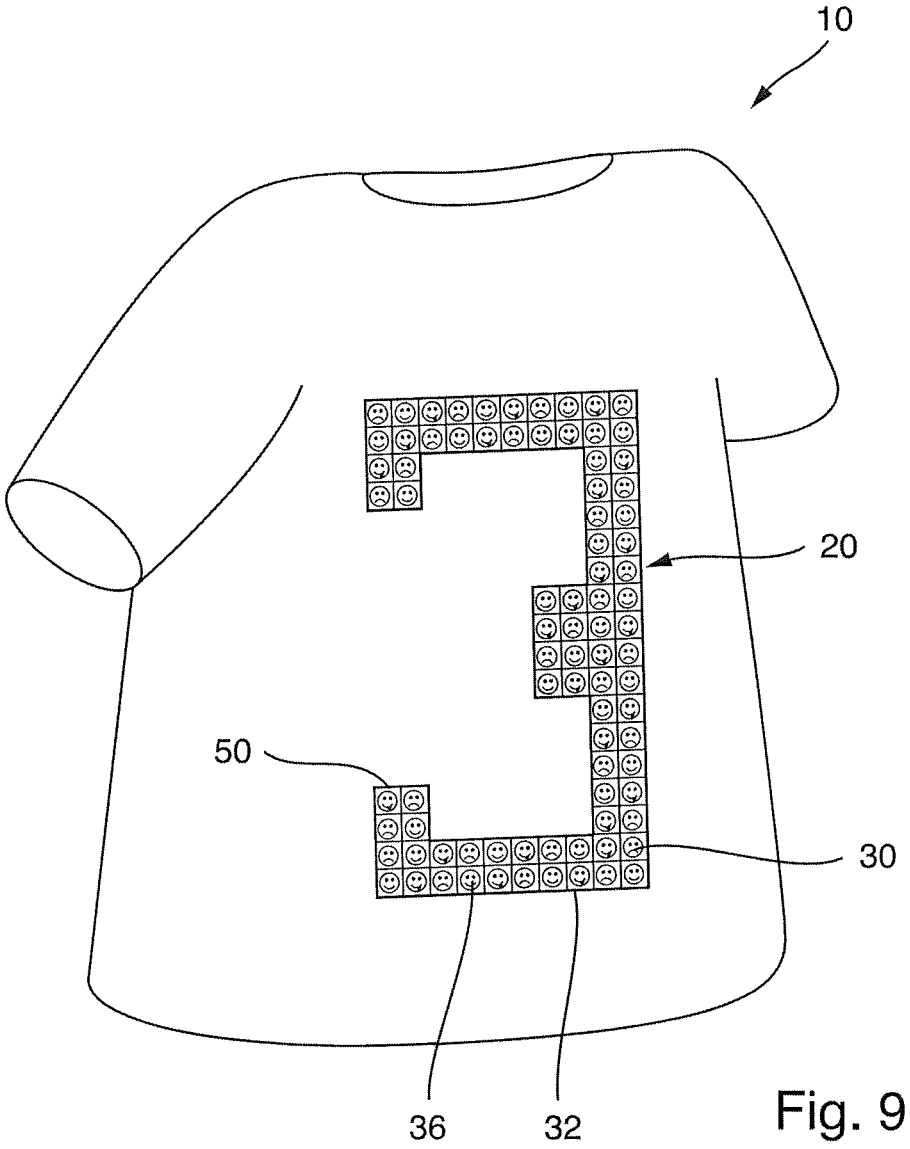
FIG. 9 is a diagram that schematically illustrates a perspective view of a piece of sports and leisure clothing, having a geometric pattern thereon.
Figure 10:
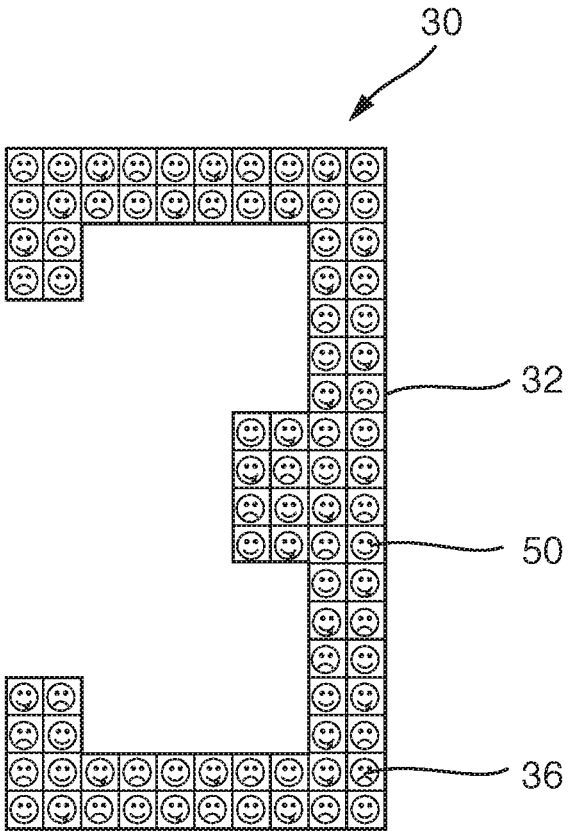
FIG. 10 is a diagram that schematically illustrates a detailed view of the geometric pattern of FIG. 9.

FIG. 9 illustrates a piece of sports and leisure clothing 10 having a geometric pattern 20 thereon. The geometric pattern comprises a base item 30. The base item 30 has a base boundary 32. The area encompassed by the base boundary is divided into subareas 36. A plurality of images 50 is spread over the subareas 36, so that within each sub area 36 one image 50 is disposed. The allocation of the images 50 visually defines the base boundary 32. In other words, the images are allocated in a way so that in the overall appearance the base item becomes visible. FIG. 10 is a detailed view of the geometric pattern of FIG. 9.

The geometric pattern, which has been described in the context of a piece of sports and leisure clothing may also be provided on other articles which are related to the general realm of sports and sports merchandising, such as perimeter advertising, team busses, airships, stadium displays, sports equipment or the like.

The base items of the geometric pattern illustrated in the FIGS. 1 to 9 are angular. However, also base items with rounded corners are possible.

As far as applicable, all individual features which are; illustrated in the various embodiments, can be combined and/or exchanged without departing from the scope of the invention.

LIST OF REFERENCE SKINS

10 Piece of sports and leisure clothing
20 Geometric pattern
30 Base item

32 Base boundary
34 Inner boundary
36 Subarea
40 Surrounding area
42 Subarea
44 Section
45 Section
50 Image

What is claimed is:

1. A method comprising a computer for generating a geometric pattern on a piece of sports and leisure clothing the method comprising:

loading surface data of the piece of sports and leisure clothing into the computer;

loading a base boundary into the computer, wherein the base boundary forms a contour of a base item that is to be visualized on the piece of sports and leisure clothing, dividing a surrounding area of the surface along the base boundary outside the base item into a plurality of subareas bordering among each other, loading a plurality of images into the computer, distributing the plurality of images over the plurality of subareas bordering among each other, so that each subarea contains at least one image, and such that the plurality of subareas visually define the contour of the base item formed by the base boundary, wherein the base boundary defines a visually abrupt transition from the base item to the surrounding area, and generating the geometric pattern on the piece of sports and leisure clothing.

2. A method comprising a computer for generating a geometric pattern on a piece of sports and leisure clothing, the method comprising:

loading surface data of the piece of sports and leisure clothing into the computer, loading a base boundary into the computer, wherein the base boundary forms contour of a base item that is to be visualized on the piece of sports and leisure clothing, dividing an area of the surface along the base boundary that is encompassed by the base boundary into a plurality of subareas bordering among each other, loading a plurality of images into the computer, distributing the plurality of images over the plurality of subareas bordering among each other, so that each subarea contains one image, and such that the plurality of subareas visually define the contour of the base item formed by the base boundary, wherein the base boundary defines a visually abrupt transition from the base item to the area encompassed by the base boundary, and generating the geometric pattern on the piece of sports and leisure clothing.

* * * * *